United States Patent [19]

Madison

[11] Patent Number: 4,951,573

[45] Date of Patent: Aug. 28, 1990

[54] TIE REMOVER AND INSERTER

[75] Inventor: Harry Madison, Germantown, Tenn.

[73] Assignee: Harsco Corporation, Wormleysburg, Pa.

[21] Appl. No.: 240,516

[22] Filed: Sep. 6, 1988

[51] Int. Cl.[5] ..... E01B 29/06; E02F 5/22

[52] U.S. Cl. ..... 104/9; 37/105; 37/DIG. 3; 37/117.5

[58] Field of Search ..... 104/5, 6, 9, 279; 37/104, 105, DIG. 12, DIG. 3, 117.5

[56] References Cited

U.S. PATENT DOCUMENTS

| | | | |
|---|---|---|---|
| 2,756,520 | 7/1950 | Soule | 37/104 X |
| 3,047,968 | 8/1962 | Keller et al. | 105/5 X |
| 3,430,700 | 3/1969 | Marron | 37/DIG. 12 X |
| 3,780,664 | 12/1973 | Holley et al. | 104/9 |
| 3,964,397 | 6/1976 | Duringer et al. | 104/9 |
| 4,282,663 | 8/1981 | Theurer | 104/6 X |
| 4,360,980 | 11/1982 | Gorvir | 37/DIG. 12 X |
| 4,392,433 | 7/1983 | Nyland | 104/9 |
| 4,809,614 | 3/1989 | Theurer et al. | 104/9 X |

OTHER PUBLICATIONS

"W-119 Boom and Cab Design" by applicant, general Sketch and operation of W-119 submitted on 2/27/90 for consideration purposes.

*Primary Examiner*—Andres Kashnikow
*Assistant Examiner*—Kevin P. Weldon
*Attorney, Agent, or Firm*—Kerkam, Stowell, Kondracki & Clarke

[57] ABSTRACT

A tie remover/inserter machine uses the vehicle and bucket of a conventional backhoe with various modifications. Grader blades are added to the loader bucket such that the machine may be used for grading ballast along a railroad track. Rail engagement wheels which may be raised and lowered are mounted to the chassis of the vehicle. A three section telescopic boom is equipped with a tie clamping device that also has the ability to tilt a tie in relation to the boom. The boom may be pivoted about horizontal and vertical axes. The boom is mounted to the vehicle by way of a side shift carriage which allows the proximal end (i.e., end closest to the vehicle) of the boom to be moved towards the center line of the vehicle so as to allow the vehicle to meet road clearance limitations.

27 Claims, 10 Drawing Sheets

58
72
75
76
64
54
62
70
73
56
64
60
68
66
68
62

TIE REMOVER AND INSERTER

BACKGROUND OF THE INVENTION

This invention relates to a machine for removing and inserting ties on a railroad track and a method for making such a machine.

In order to maintain railroad tracks in safe operating conditions, it is necessary to replace the ties periodically. The ties (made of wood, metal or concrete) underneath the rails tend to wear out after an extended period of use.

Various machines for removing and/or inserting railroad ties have been developed.

Among the prior machines for replacing ties are the machines disclosed by the following patents:

| Patent No. | Inventor | Issue Date |
|---|---|---|
| 3,780,664 | Holley et al. | 12/25/73 |
| 4,392,433 | Nyland | 7/12/83 |

The Holley et al patent shows a machine for inserting ties beneath a railroad track having a pantograph system to control the orientation of a tie clamp which is used for manipulating the tie. As common with many types of machines for removing ties, the arrangement includes rail clamps to secure the machine to the rail and a jacking system for supporting the machine on the ground while using the rail clamps to lift the rails to more easily remove or insert the tie disposed below the rail.

The Nyland patent shows a backhoe type tie remover/inserter. An articulated arm at one end of the machine is used to manipulate ties. The other end of the machine has a loader bucket as commonly used on regular backhoes. The machine has tractor wheels for running on the road and a second set of wheels for rolling along a railroad track. Vertical "outrigger" jacks may be moved horizontally and used to support the vehicle as best shown at FIG. 6. Rail clamps may be used in combination with the vertical jacks in order to raise the rail for making it easier to insert or remove a tie from a particular portion of the track.

Although the prior tie remover/inserter machines have been generally useful, they have been subject to one or more of a number of disadvantages.

Such machines have generally required a separate machine for regrading the ballast after the ties have been replaced.

A further disadvantage of many prior tie remover/inserter machines is that the machines must be specially constructed almost in their entirety. That is, some designs are ill-suited for modifying a previously existing machine such as a conventional backhoe.

A further disadvantage of some prior tie inserter/remover machines which use modified versions of conventional backhoes is that the articulated arm common to a backhoe is not well-adapted for easy manipulation of a tie. Especially where one is trying to insert or remove a tie, the tie clamp must be moved in a straight line. Using a articulated arm arrangement as in common to regular backhoes requires care in order to ensure that the rail clamp at the distal end of the articulated arm is moved in a straight line.

Although some prior tie remover/inserter machines have been vehicles which may operate on roads and on rails, it is often difficult to make such machines sufficiently narrow as to meet laws which limit the width of vehicles traveling normally on the roadways. This problem of designing the tie remover/inserter mechanism so that it does not exceed road clearance limitations may at least partly arise from the fact that prior designs generally have used a tie remover/inserter arm which is secured to a fixed pivot point the rear of the vehicle.

OBJECTS AND SUMMARY OF THE INVENTION

Accordingly, it is a primary object of the present invention to provide a new and improved tie remover/inserter machine.

A more specific object of the present invention is to provide such a machine which is also operable to grade the ballast on a railroad track.

A further object of the present invention is to provide a design which may be contracted using substantial portions of pre-existing conventional backhoe machines.

Another object of the present invention is to provide such a machine which has a tie clamp mounted so that it and any tie which it is clamping to may easily be moved in a straight line.

Yet another object of the present invention is to provide a mounting arrangement for the tie remover/inserter mechanism so that the machine may readily meet road clearance limitations, while at the same time be well-positioned for removal and insertion of ties.

The above and other objects of the present invention which will become more apparent as the description proceeds are realized by a machine for removing and inserting railroad ties which includes a vehicle body having first and second ends and first and second sides. Wheels are attached to support the vehicle body. A tie remover/inserter mechanism is mounted to the vehicle body. A bucket (as used herein a "bucket" is a loader bucket from a generally conventional backhoe) has a front, a back, and first and second sides and is mounted to the first end of the body by at least one bucket support arm which is pivotable about a horizontal pivot axis at a horizontal pivot point. A bucket hydraulic cylinder is connected to the body and to the bucket support arm and is operable to lift and lower the bucket by causing the bucket support arm to pivot about the horizontal axis. At least a first grader blade is mounted to the first of the sides of the bucket. Preferably the first grader blade is movably mounted to the first of the sides of the bucket and is disposable in a non-grading upper position and a grading lower position. The first grader blade is pivotably mounted to the first of the sides of the bucket by first and back blade support arms. A first blade hydraulic cylinder is operable to lift and lower the first grader blade. A second grader blade operable and constructed in identical fashion to the first grader blade is disposed at the second of the sides of the bucket. The tie remover/inserter mechanism is mounted to the second end of the vehicle body.

In another important aspect of the present invention, the tie remover/inserter mechanism includes a telescoping boom having a tie clamp at a distal end thereof, the telescoping boom being pivotable about a vertical pivot axis adjacent a proximal end thereof. The telescoping boom is further pivotable about a horizontal pivot axis at the proximal end. The wheels include four ground engagement wheels such that the machine is operable to travel on roads and four rail engagement wheels such that the machine is operable to travel on rails. The tie remover/inserter mechanism is operable to pivot the telescoping boom about an axis which is widthwise offset from a central axis extending lengthwise to the machine. The horizontal pivot axis and the vertical pivot axis are each disposed on a side shift carriage which is movable in a widthwise direction relative to the vehicle body. A first boom hydraulic cylinder for pivoting the telescoping boom about the vertical pivot axis and a second boom hydraulic cylinder for pivoting the telescoping boom about the horizontal pivot axis are used for manipulating ties.

In another important aspect of the present invention, a side shift carriage is mounted to the vehicle body. The tie inserter/remover mechanism is mounted to the vehicle body by way of the side shift carriage which is movable in a widthwise direction relative to the vehicle body.

A further important aspect of the present invention is a method of making a machine for removing and inserting railroad ties. The steps, not necessary in order, include attaching a support structure to a frame of a tractor, the tractor having a body, two front wheels for grounding engagement and defining a front axis and two rear wheels for ground engagement and defining a rear axis. There is an interaxis zone between the front axis and the rear axis. A tie remover/inserter mechanism is mounted to the support structure, the mechanism having a telescoping boom with a tie clamp at the distal end thereof. The telescoping boom has a proximal end which is mounted such that it will be disposed at an end of the tractor and outside of the interaxis zone and such that the telescoping boom can extend parallel to the rear axis for tie remover/insertion operations. The attaching step involves attaching the support structure to the frame of a standard industrial tractor commonly used for making a backhoe machine. The support structure is pivotable attached at a part of the frame in the interaxis zone and movably attached to a part of the frame outside the interaxis zone such that the support structure is movably up and down relative to the frame. The method further includes the step of mounting rail engagement wheels to the support structure. The mounting step involves the substeps of mounting the tie remover/inserter mechanism to a side shift carriage and mounting the side shift carriage to the support structure such that the side shift carriage is movable in a widthwise direction relative to the body. The method further includes the step of mounting a first greater blade to a bucket disposed at one end of the vehicle.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
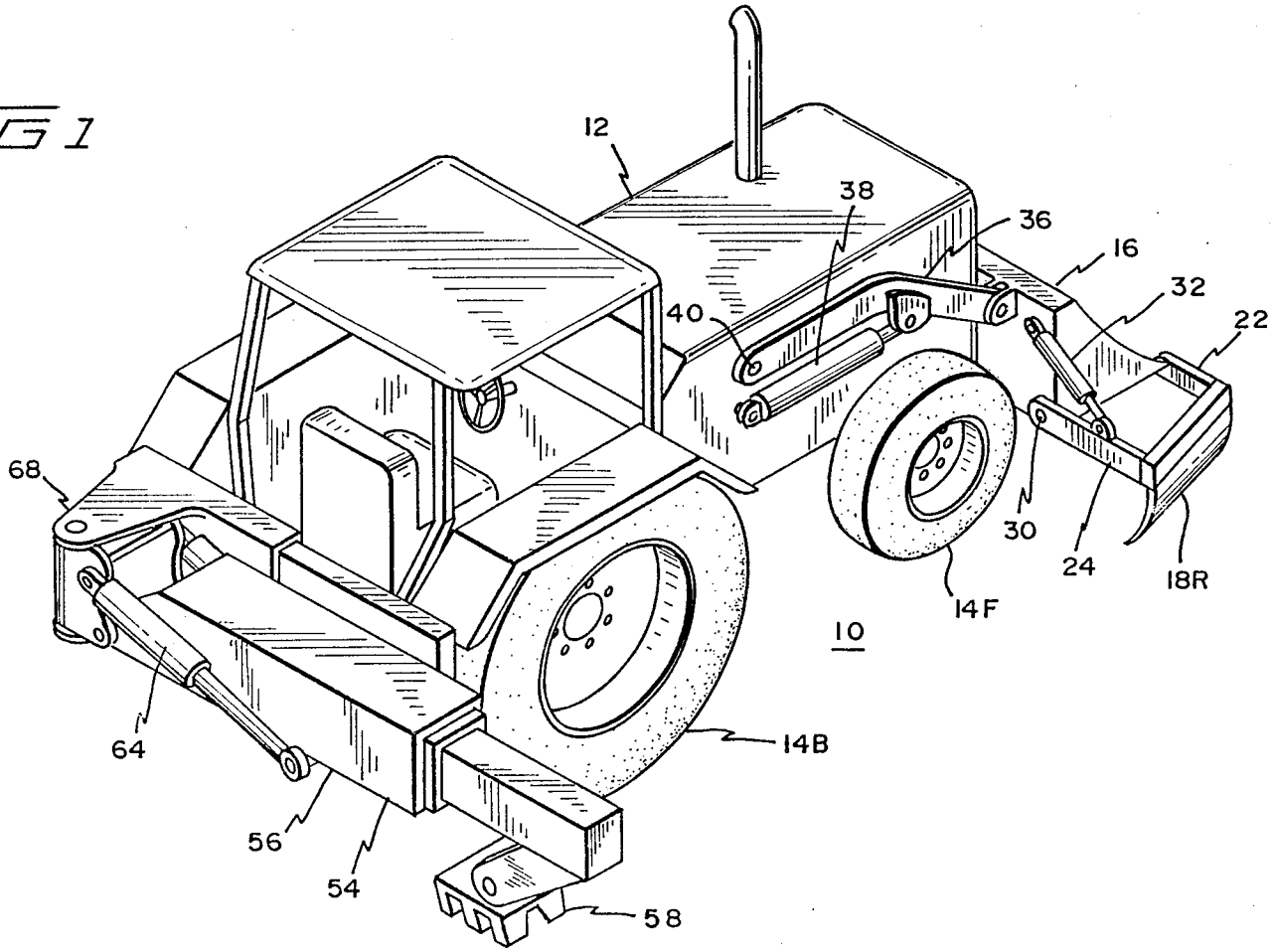
FIG. 1 shows a simplified perspective view of the present invention.

As shown in FIG. 1, the present invention 10 includes a vehicle body 12 and front and back road wheels 14F and 14B respectively. The body 12 and wheels 14F and 14B are preferably conventional structures from generally available backhoe machines. The wheels 14F and 14B define respective front and rear parallel axes corresponding to their axes of rotation when positioned to go straight ahead. Since the present machine 10 may advantageously be constructed by modifying a conventional backhoe machine, the description which follows will concentrate on those features which are different from a conventional backhoe.

Figure 2:
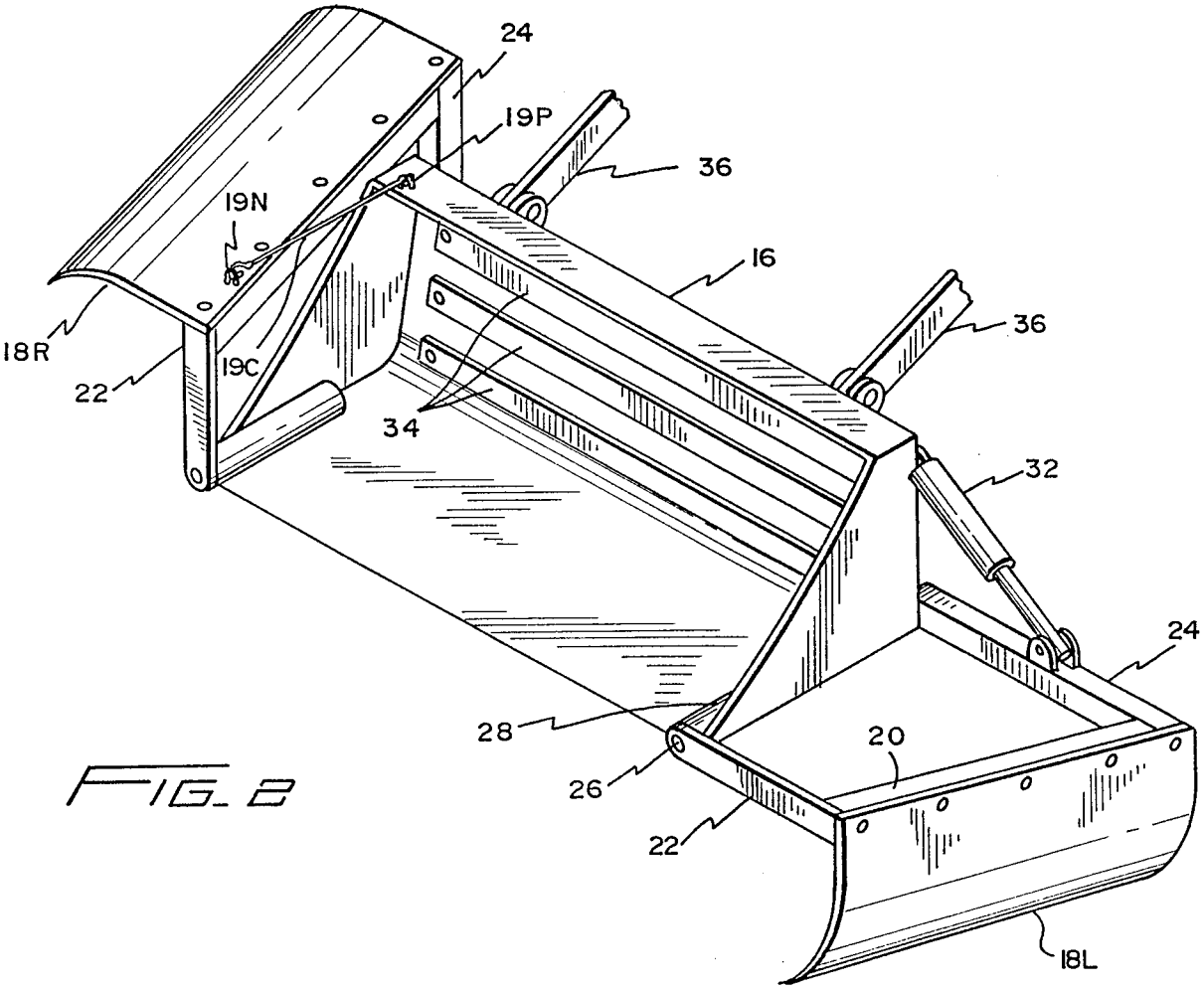
FIG. 2 shows a simplified perspective view of a grader arrangement used with the present invention.

As shown by FIGS. 1 and 2, a conventional loader bucket 16 has been modified to include right and left grader blades 18R and 18L. The construction and operation of the grader blade 18L will be discussed in detail, it being readily understood that the construction and operation of blade 18R is identical. The blade 18L is mounted to a member 20 which extends between a front support arm 22 and a back support arm 24. The front support arm 22 is pivotably mounted by having a pin 26 fixed to the end of arm 22 and operable to rotate in a sleeve 28 which has been added to the bucket 16. As shown with respect to blade 18R in FIG. 1, the back support arm 24 has a pin 30 which seats within a hole (not visible) on the back of the bucket 16. For any particular grader blade, the front and back pins of the corresponding support arms are coaxial so as to define a grader blade pivot axis which is transverse (and more specifically perpendicular) to the width of the bucket 16. A blade operating hydraulic cylinder 32 is pivotably mounted between the back of the bucket 16 and the arm 24 so as to allow the grader blade 18L to be moved between its grading lower position shown in FIG. 2 and a non-grading position such as shown for blade 18R in FIG. 2. A series of steel bars 34 may be welded, bolted, or otherwise secured to the inside back of the bucket 16 in order to serve as counter weights.

As shown in simplified form only at the left side of FIG. 2, an arrangement may be used to secure the grader blade 18R in its upper non-grading position shown in FIG. 2. Specifically, a chain or cable 19C may be fixed at point 19P to the bucket 16. The chain 19C may be fixed at point 19P by an eyelet, bolt, or other arrangement. The other end of the chain 19C has a pin 19N which extends in a corresponding hole in the blade 18R. To allow the blade 18R to be pivoted to its lower position, one simply manually removes the pin 19N. A similar arrangement (not shown) may be used for the blade 18L.

The loader bucker 16 is connected by arms 36 to the vehicle body 12 and is pivotable by the hydraulic cylinder 38 in FIG. 1 and a corresponding cylinder (not visible) which is symmetrically arranged on the opposite side of the vehicle body 12.

Advantageously, the grader blades 18R and 18L may be pivoted about a widthwise extending horizontal pivot axis corresponding to pivot point 40 (FIG. 1 only) by operation of the hydraulic cylinders such as 38. By operation of the hydraulic cylinders 38, the angle (relative to a horizontal plane) of the grader blades 18R and 18L may be adjusted by tilting the bucket 16, which is fixed relative to the front of arms 36, at an angle. In other words, changing the orientation of the bucket 16 may be used to raise or lower the grader arm 22 relative to the grader arm 24 so as to vary the blade 18R or 18L relative to the horizontal plane. The relation of the length of arm 22 to the length of arm 24 makes the blades have an angle of about 45° relative to the lengthwise or direction of travel of the vehicle.

Figure 6:
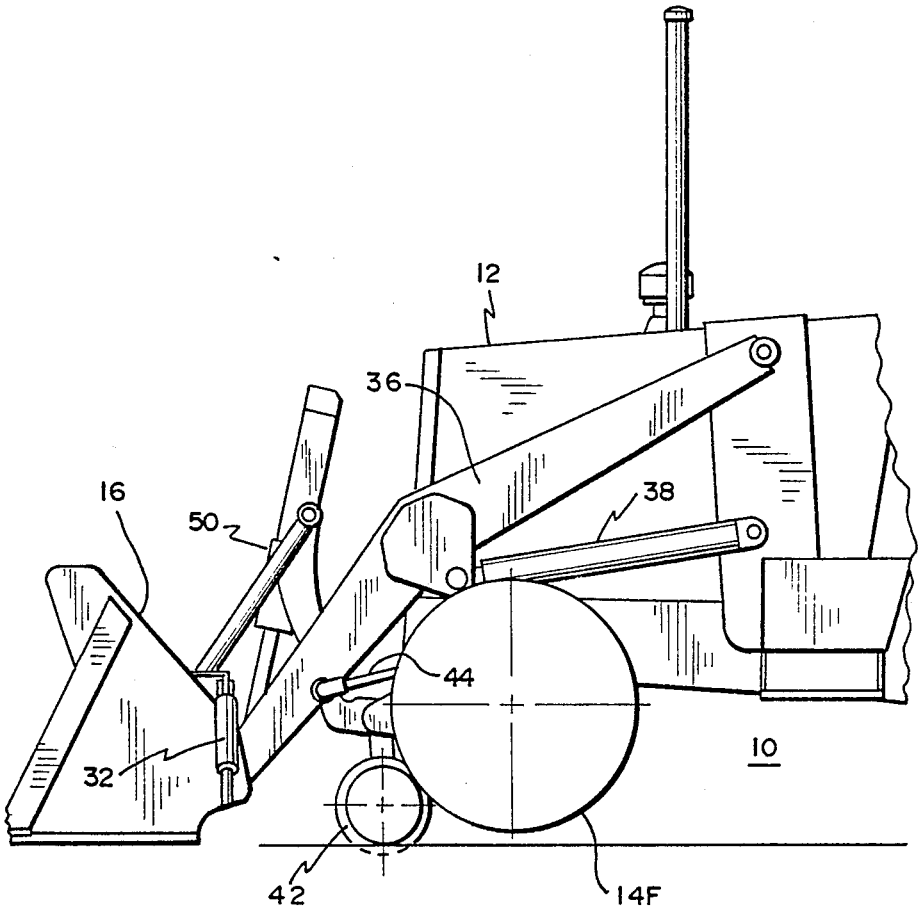
FIG. 6 shows a more detailed side view of the grader arrangement and front portion of the present invention.
Figure 7:
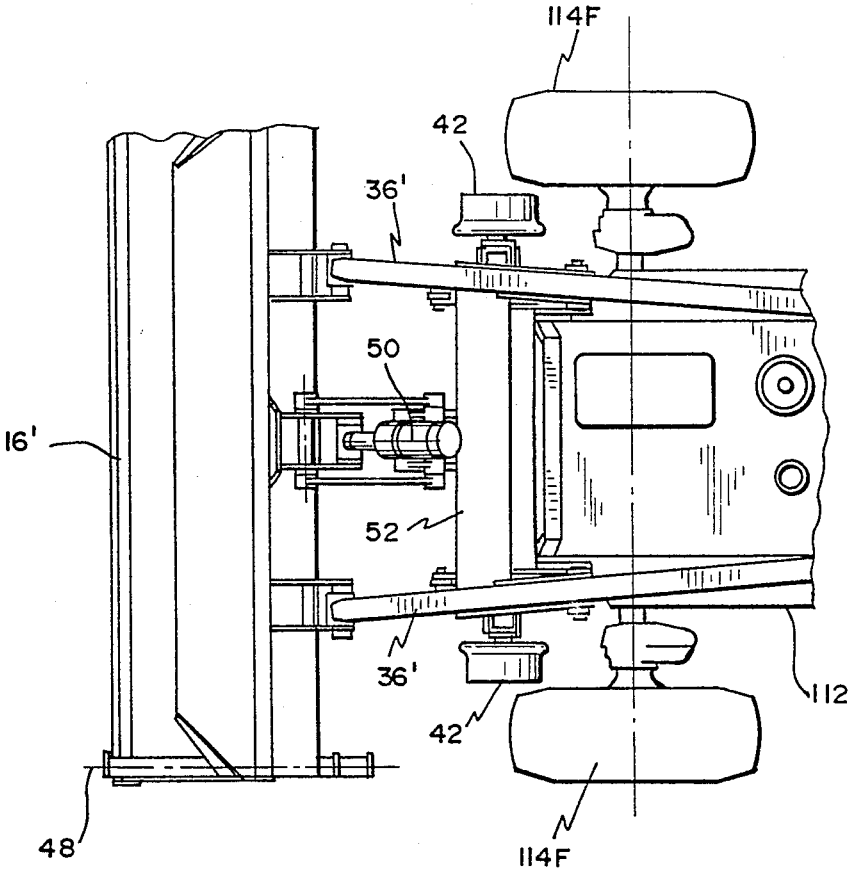
FIG. 7 shows a top view of the grader arrangement and front portion of the present invention.

With reference now to FIGS. 6 and 7, several additional details with respect to the front portion of the machine 10 will be discussed. Rail engaging wheels 42 may be used to operate the machine 10 on a rail. The rail engaging wheels 42 may be added to the undercarriage of the machine 10 which, as noted above, may originally be a conventional backhoe device. The wheels 42 may be lowered and raised by hydraulic cylinder 44 (only partially visible in FIG. 6). It should be noted that the wheels 42 and their mountings to the machine 10 need not be discussed in detail as the use of such wheels which may be raised to allow the vehicle to ride on the roadway and may be lowered to allow the vehicle to ride upon rails of a railroad track are well known.

The blades such as 18L are mounted by way of members 22 and 24 which allow the blade to pivot about axis 48 (FIG. 7 only). Blades 18R and 18L are left out of FIG. 7 for ease of illustration, whereas blade 18L is left out of FIG. 6. It should be noted that the axis 48 extends lengthwise (i.e., in the direction of the vehicle length). Depending upon the setting of a hydraulic cylinder 50 as well as the hydraulic cylinder 38 (and a corresponding hydraulic cylinder not shown on the other side of the vehicle 12), the axis 48 may be disposed horizontally or may have its front or rear end lifted higher. The optional cylinder 50 is mounted to a bar 52 which extends between the two arms 36. Operation of the hydraulic cylinder 50 allows one to change the orientation of the bucket 16 independent of the position of the arms 36.

Considering now FIGS. 1, 3, and 4, a tie remover/inserter mechanism 54 will be discussed in detail. The mechanism 54 includes a telescoping boom 56 having three different sections as shown and having a tie clamp 58 (shown in simplified form) mounted at a distal end of the boom 56. A proximal end (i.e., closest to the vehicle) of the boom 56 is pivotably connected at point 60. Two portions 62 which may be part of a common u-shaped member (the u-shape would be the cross section in a horizontal plane) or which may simply be two different pieces which are rigidly connected by a third piece. The boom 56 pivots relative to a horizontal axis corresponding to point 60 and a similar point which is not visible in FIG. 4. Hydraulic cylinders 64 are pivotably connected at each of their ends and serve to raise and lower the tie clamp 58 by rotating the boom 56 about pivot axis 60. The boom 56 may be rotated about a vertical pivot axis corresponding to point 66. The vertical pivot axis corresponding to point 66 extends between upper and lower plates 68 which are part of a side shift carriage 70.

Figure 3:
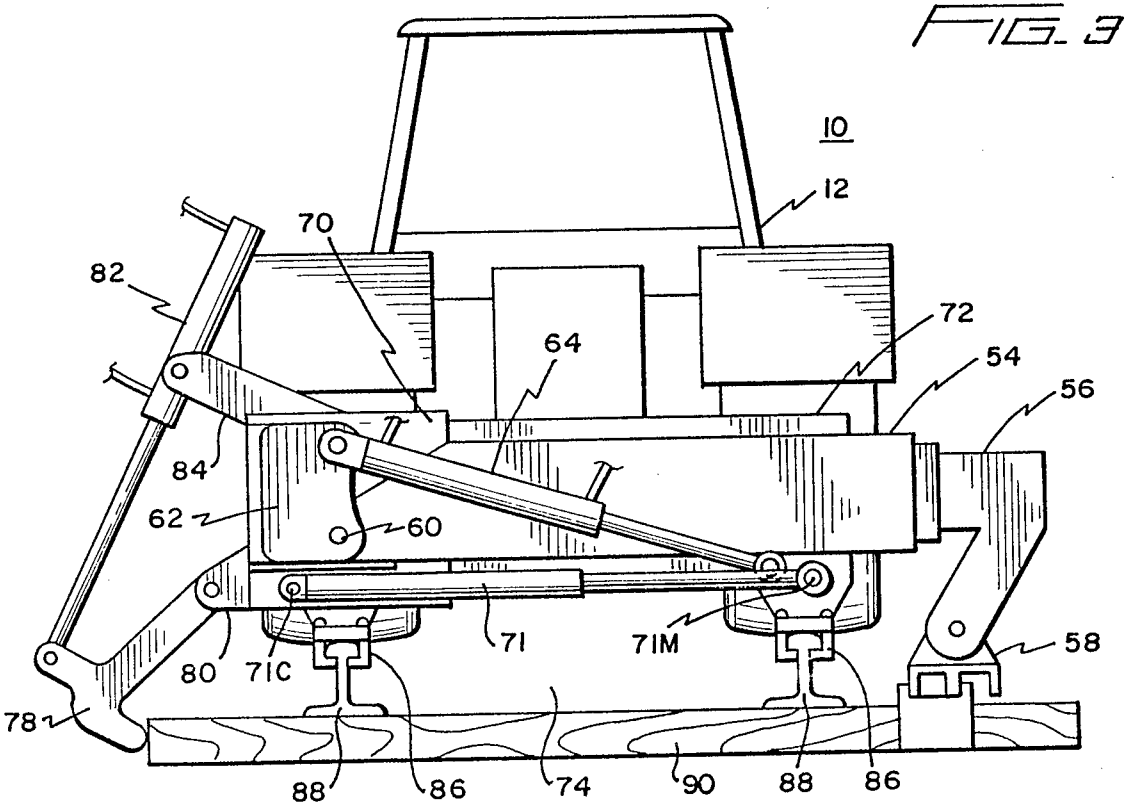
FIG. 3 shows a simplified end view of a tie remover-/inserter mechanism used with the present invention.

The side shift carriage 70 is mounted for moving along a mounting plate 72 such that the pivot axes corresponding to points 60 and 66 may be moved relative to the lengthwise extending center line shown as point 74 in end view of FIG. 3. A side shift hydraulic cylinder 71 (FIG. 3 only), is attached to the carriage 70 at point 71C and is attached to the mounting plate at point 71M. The cylinder 71 is used to slide carriage 70 along the mounting plate 70. As shown in FIG. 4, the carriage 70 has an upper portion 76 which extends across the top of mounting plate 72 and turns downwardly therefrom. It will be noted that a portion of mounting plate 72 has been deleted from FIG. 4 in order to more clearly illustrate how upper portion 76 captures the carriage 70 to the mounting plate 72. It will also be readily understood that a lower portion of the carriage 70 would be symmetrical with the upper portion 76 and would also serve to capture carriage 70 to plate 72.

Figure 4:
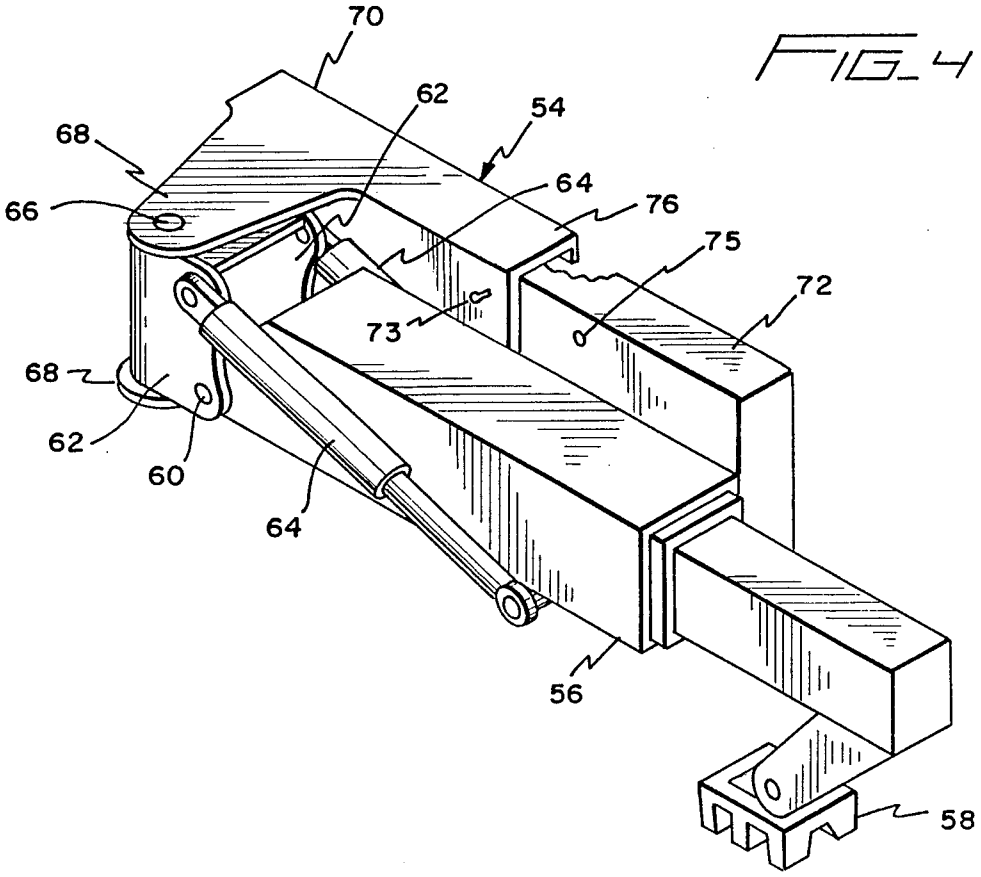
FIG. 4 shows a simplified perspective view of the tie remover/inserter mechanism.

As illustrated in FIG. 4 only, a locking pin 73 may be used to secure the carriage 70 to the mounting plate 72 by way of holes such as 75 (only one shown) which extend through the mounting plate 72. Upon the carriage 70 reaching the desired position on the mounting plate 72, a locking pin 73 is inserted into a corresponding hole in the side shift carriage 70, which hole has been placed in registry with a hole such as hole 75 in the mounting plate 72. The locking pin 73 may extend completely through the mounting plate 72 and be clipped on the side of plate 72 opposite to the entry point for the pin 73. A similar locking pin to pin 73 could also be used underneath the boom 56 and/or at other locations on the carriage 70 so as to ensure that one can readily secure the carriage 70 to the mounting plate 72. The mounting plate 72 would of course include several sets of holes 75 corresponding to the positions in which the carriage 70 would be secured to the mounting plate 72.

With reference to FIG. 3, a kicker member 78 and associated parts will be discussed in detail. The kicker 78 and associated parts have been left out of the views of FIGS. 1 and 4 for ease of illustration. The kicker 78 is pivotably mounted to a flange 80 extending out from the carriage 70 and is pivotably mounted to a hydraulic cylinder 82 which is pivotably mounted to the carriage 70 by way of trunion 84.

Rail clamps 86 may be used to clamp the rails 88 as shown in FIG. 3. The rail clamps 86 may be used to secure the machine 10 to the rail when one is moving a tie such as tie 90 of FIG. 3 using the tie clamp 58. It should be appreciated that the rail clamps 86 are relatively common on various rail machines and need not be described in detail.

Figure 5:
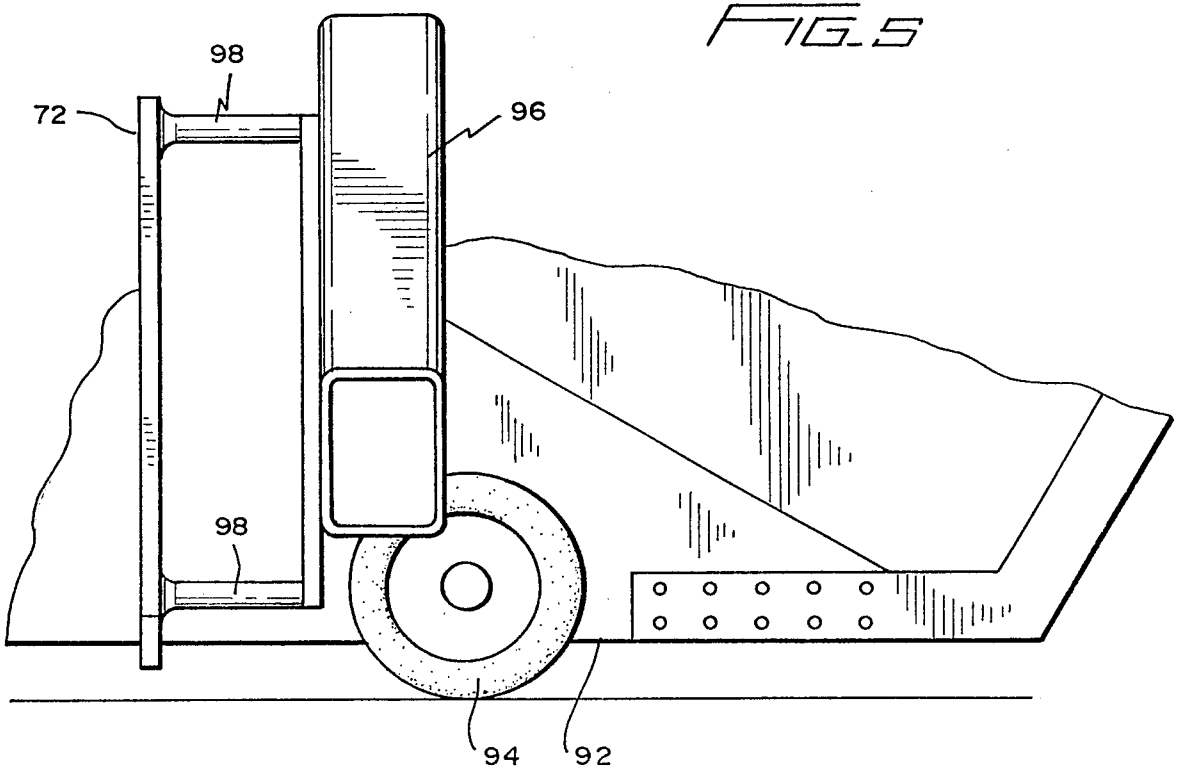
FIG. 5 shows a simplified side view of a portion of the tie remover/inserter mechanism.

With reference now to FIG. 5, it will be noted that the mounting plate 72 is part of a support structure 92 having rail engaging wheels 94 and the jack structure 96 which, like the other portions, are shown in simplified fashion in FIG. 5. As shown in FIG. 5, the mounting plate 72 is offset by members 98 such that the carriage 70 (not shown in FIG. 5) may be captured to the mounting plate 72 in the fashion illustrated in FIG. 4.

Figure 8:
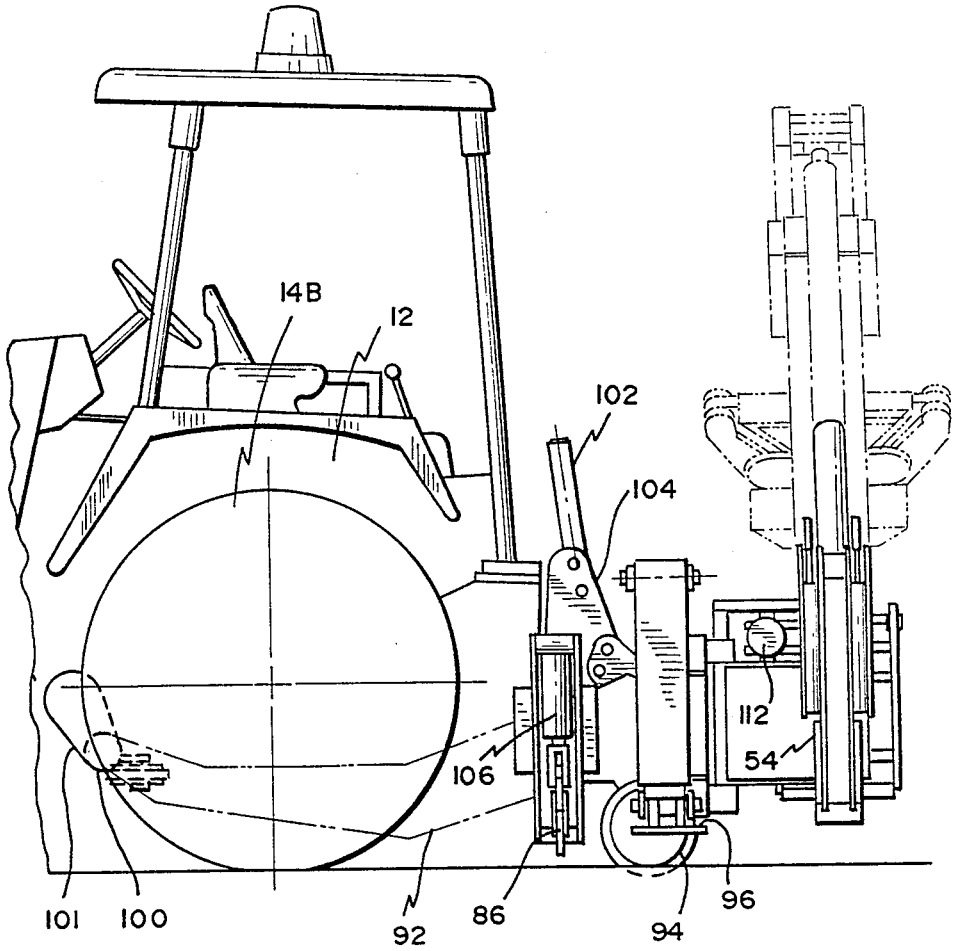
FIG. 8 shows a detailed side view of the tie remover-/inserter mechanism and back portion of the present invention.
Figure 9:
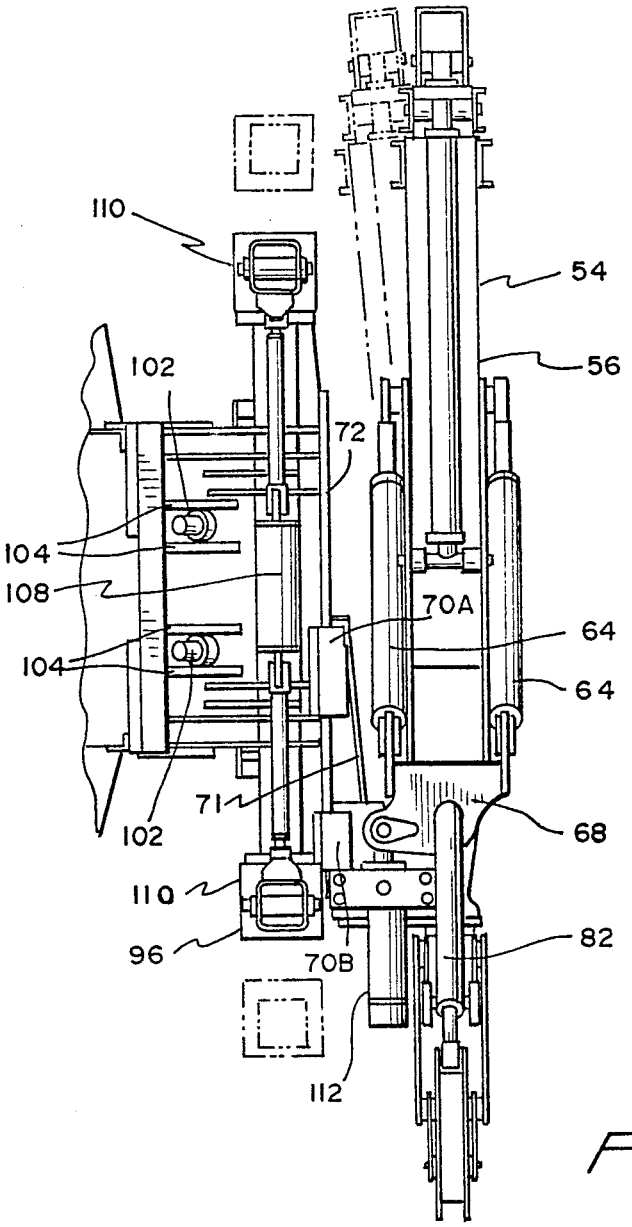
FIG. 9 shows a detailed top view of the tie remover-/inserter mechanism and back portion of the present invention.
Figure 10:
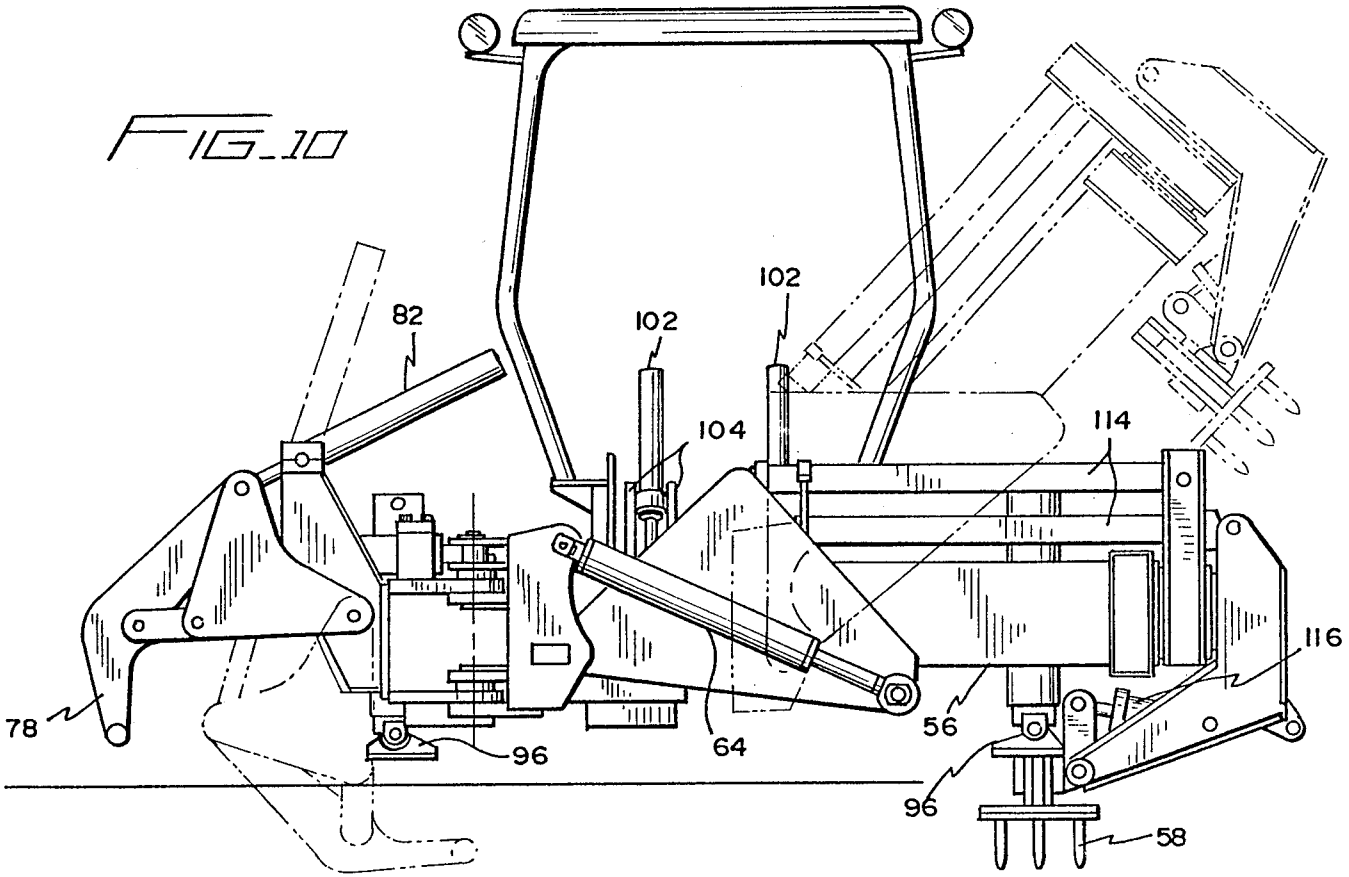
FIG. 10 shows a detailed end view of the tie remover-/inserter mechanism of the present invention.

With reference now to FIGS. 8, 9, and 10, more details of the structures at the rear of the vehicle body 12 will be discussed. The support structure 92 is pivotably mounted at point 100 to mounting plate 101 extending from the frame or chassis and may be raised or lowered relative to the vehicle body 12 by hydraulic cylinders 102 which are pivotably mounted to the plates 104. Plates 104 are in turn fixed to the frame or chassis of the vehicle. The lower or rod end of hydraulic cylinders 102 is pivotably connected (the connection is not visible in the views) to the support structure 92. Accordingly, the hydraulic cylinders 102 may be used to raise and lower the support structure 92 and the components disposed thereon including the tie remover/inserter mechanism 54. If desired, the jacking arrangement 96 and/or the rail clamps 86 (which are operated by hydraulic cylinders such as 106 in known fashion) are disposed as shown mounted on the support structure 92. Alternately, the jacking arrangement or mechanism 96 and the rail clamp mechanisms 86 and associated parts can be secured to the chassis of the machine 10 with the support structure 92 extending between the mechanisms associated with the jacking arrangement 96 and rail clamps 86.

The jacking arrangement 96 may include a cylinder 108 which is used to extend vertical cylinders 110 outwardly from the vehicle (as shown in the phantom line positions of FIG. 9) whereupon the vertical cylinders 110 may be extended so as to partially support the vehicle upon the ground.

As shown in FIGS. 8 and 9, a cylinder 112 would be used to cause the boom 56 to pivot about the vertical axis corresponding to point 66 in FIG. 4.

As best shown in FIG. 9, the simple carriage 70 of FIG. 4 has been replaced by a slightly modified carriage having part 70A and 70B connected together by member 71. The portions 70A and 70B would slide along mounting plate 72 in the same fashion as discussed in detail above.

As shown in FIG. 10, the three sections of telescoping boom 56 may be extended and retracted by way of hydraulic cylinders 114 mounted parallel and above the telescoping sections. For ease of illustration, the telescoping sections have been left out of the other FIGS. However, it should also be noted that, if desired, the hydraulic cylinders used to extend the telescoping boom 56 might be internal to the sections of the boom itself.

As also appears from FIG. 10, the tie clamp 58 includes a hydraulic cylinder 116 which may be used to tilt the tie clamp 58 relative to the boom 56. This allows the mechanism to reorient a tie so that it is not necessarily parallel to the boom 56. It should also be noted that the tie clamp 58 includes two jaws, in known fashion, which clamp together based upon a hydraulic cylinder which is not visible in FIG. 10, but would extend perpendicular to the plane of FIG. 10. As the details of various tie clamp mechanisms are well known, the hydraulic cylinder which causes clamping action by the clamp 58 need not be shown.

The operation of the present invention is relatively straightforward. The tractor wheels 14F and 14B may be used for traveling along the ground or a regular roadway, whereas the rail wheels 42 (FIG. 6) and 94 (FIG. 8) may be used for traveling along a railroad track. When the vehicle 10 is traveling along rails and reaches a tie which is to be removed, the telescoping boom 56 is placed approximately parallel to and above the tie which is to be removed. With reference to FIG. 3, the rail clamps 86 are used to secure the machine 10 to the rails 88. Additionally, and if acceptable to the particular rail company at the particular location, the vertical jacks 110 may be moved outwardly by operation of jack 108 and the jacks 110 may be extended vertically (the jacks are best shown in FIG. 9). By extending the vertical jacks 110, the clamps 86 would tend to lift the rail 88 off the tie 90, thereby making it easier to remove the tie 90. Concern over causing deformities in the rail 88 may cause some rail lines to instruct one not to lift the rails 88 in this manner. Whether or not the rails 88 have been lifted by use of the jacking system in combination with the rail clamps 86, the telescoping boom 56 may be extended such that the tie clamp 58 extends down to grab the tie 90. After it has grabbed the tie 90, the telescoping boom 56 is extended parallel to the tie 90, thereby pulling the tie 90 out from under the rails 88. At the same time, the kicker 78 is activated to push on the other end of the tie 90 so as to help with the removal of the tie 90 for at least a portion of its travel.

In order to insert a new tie, the tie clamp 58 grabs the tie and orients it properly relative to the rail (cylinder 116 in FIG. 10 may be useful for this purpose). Eventually, the tie 90 is parallel to the telescoping boom 56 and is generally horizontal. The boom 56 is then retracted such that the tie 90 is inserted into the roadbed below the rails 88.

Following the insertion of the tie 90, the machine may move on to the next tie which needs replacement.

Although the above process has been described using a single machine for both removal and insertion of ties, it may be readily appreciated that use of two such machines may speed up the process. In other words, a first machine according to the present invention would be used for removing the ties, whereas a second and identical machine would move along behind the first machine and would be used to insert new ties in the roadbed.

When the operator determines that the ballast needs grading, the pins such as pin 19N of FIG. 2 would be removed and the hydraulic cylinders 32 would be activated to lower the grading blades 18R and 18L to their grading position. Additionally, control of the hydraulic cylinders 38 (one shown in FIG. 1) and 50 (FIGS. 6 and 7) could be used to properly orient the grader blades 18R and 18L so as to best grade the ballast on the rail.

When the machine 10 has completed its operations, the front rail wheels 42 may be raised by hydraulic cylinder 44 (FIG. 6) and the rear rail wheels 94 (FIG. 8) may be raised by operation of hydraulic cylinders 102 lifting the complete support structure 92. The vehicle would then be supported by its tractor wheels 14F and 14B. Additionally, if it is required to travel upon a roadway with width limitations, the pins such as pins 73 may be removed and the side shift carriage 70 may be moved to a more central location on the mounting plate 72. This operation may be done before the rail engagement wheels are lifted. The side shift cylinder 71 is used to shift carriage 70. Alternatively, if no side cylinder 71 is included in the machine, the telescoping boom 56 and its associated hydraulic cylinders may be used for moving the carriage 70 relative to the mounting plate 72 when the vehicle is held stationary. That is, the tie clamp 58 may be secured to something which is relatively fixed and the telescoping boom may be made to telescope such that the carriage 70 moves along mounting plate 72 until it reaches the desired position. At the desired position, the locking pins such as 73 would be reinserted so that the carriage 70 is secured to the mounting plate 72. For road travel, the carriage 70 may be secured at a central location on the mounting plate 72 and the hydraulic cylinder 112 may be activated to cause the boom 56 to extend parallel to the lengthwise direction of the vehicle itself. With reference to FIG. 9, it will be appreciated that movement of the carriage portion 70A and 70B to a central location on the mounting plate 72 will considerably narrow the width of the vehicle after the boom 56 has been rotated 90° clockwise in the view of FIG. 9. Indeed, the carriage 70 and inserter/remover mechanism 54 including boom 56 will be completely disposed between (i.e., in the widthwise direction, but behind) the rear wheels 14B.

The pins such as 19N which secure the blades 18R and 18L would also be placed in position when the vehicle or machine 10 is to be transported to or from a work site.

The construction of the machine 10 of FIG. 1 is relatively straightforward. The vehicle body 12, wheels 14F and 14B, and loader bucket 16 are constructed or obtained by purchasing a standard industrial tractor commonly used for making a backhoe machine. The backhoe mechanism and the stabilizers commonly used for such a machine need not be constructed or purchased. In order to best facilitate the usage of the machine 10, the rims would be modified in know fashion to change the spacing so as to best accommodate the rails. Additionally, rock lug tires would be placed on the machine. Various minor modifications could be made to the frame such as removing pieces used for mounting equipment not applicable to the present machine. Mounting plate 101 (FIG. 8) and plates 104 (FIG. 8 and 9) would be welded or otherwise fixed to the frame or chassis. Note that the pivotable attachment point 100 for the support structure 92 (FIG. 8) is disposed in an interaxis zone which would be defined between the front and rear axis corresponding to the front end rear road engagement wheels, whereas the tie remover/inserter mechanism 54 is disposed outside of that interaxis zone and behind the rear wheels 14B at one end of the machine 10. The tie remover/inserter mechanism 54 is mounted to the support structure 92 in such a fashion that, as best shown in FIG. 9, the proximal end of boom 56 (the end adjacent plates 68) is outside of the interaxis zone between the front and rear ground engagement wheels. In addition to being pivotably attached at point 100, the support structure 92 is movably attached to the frame of the vehicle by way of plates 104 (FIGS. 8 and 9) such that the support structure is movably up and down relative to the frame. As part of the construction process, the rail engagement wheels 94 (only one visable in FIG. 8) are secured at opposite sides of the support structure 92. As part of the mounting of the mechanism 54 to the support structure 92, the tie remover/inserter mechanism 54 is mounted to the side shift carriage such as 70 in FIG. 4 and the side shift carriage 70 is mounted to the support structure 92 by way of mounting plate 72.

In addition to the above steps, the standard loader bucket 16 is modified by adding the steel bars 34 and the grader blades 18R and 18L (as shown in FIG. 2) and the associated components for moving the greater blades up and down.

As the present machine 10 is used for a different operation than the backhoe operations normally performed by the basic tractors structure, it is desirable to slightly move the operator's seat location so that he may best see the operation. Also the handles for the various hydraulic controls should be moved from their standard locations so as to best facilitate ease of operation. Such minor changes need not be described in detail.

Although various specific constructions and arrangements have been described, it is to be understood that these are for illustrative purposes only. Various modifications and adaptations will be apparent to those of skill in the art. Accordingly, the scope of the present invention should be determined by reference to the claims appended hereto.

What is claimed is:

1. A machine for removing and inserting railroad ties comprising:

a vehicle body having first and second ends and first and second sides;

wheels attached to support said body;

a tie remover/inserter mechanism mounted to said vehicle body;

a bucket having a front and back, and first and second sides and mounted to said first end of said body by at least one bucket support arm which is pivotable in a horizontal pivot axis at a horizontal pivot point;

a bucket hydraulic cylinder connected to said body and to said bucket support arm and operable to lift and lower said bucket by causing said at least one bucket support arm to pivot about said horizontal axis; and at least a first grader blade mounted to said bucket such that pivoting of said bucket support arm about said horizontal axis changes an angle of said first grader blade relative to a horizontal plane, and wherein said first grader blade is movably mounted to said first of said sides of said bucket and is disposable in a non-grading upper position and a grading lower position, and wherein said first grader blade is pivotably mounted to said first of said sides of said bucket by first front and back blade support arms and further comprising a first blade hydraulic cylinder operable to lift and lower said first grader blade.

2. The machine of claim 1 further comprising a second grader blade pivotably mounted to said second of said sides of said bucket by second front and back blade support arms and further comprising a second hydraulic cylinder operable to lift and lower said second grader blade, said second grader blade being disposable in a non-grading upper position and a grading lower position.

3. The machine of claim 1 wherein said tie remover/inserter mechanism is mounted to said second end of said vehicle body and wherein said tie remover/inserter mechanism includes a telescoping boom having a tie clamp at a distal end thereof, said telescoping boom being pivotable about a vertical pivot axis adjacent a proximal end thereof.

4. The machine of claim 3 wherein said telescoping boom is pivotable about a horizontal pivot axis at said proximal end.

5. The machine of claim 4 wherein said wheels include four ground engagement wheels such that the machine is operable to travel on roads and four rail engagement wheels such that the machine is operable to travel on rails and wherein said tie remover/inserter mechanism is operable to pivot said telescoping boom about an axis which is widthwise offset from a central axis extending lengthwise to the machine.

6. The machine of claim 5 wherein a side shift carriage mounted to said vehicle body, said tie inserter/remover mechanism mounted to said vehicle body by way of said side shift carriage which is movable in a widthwise direction relative to said vehicle body.

7. A machine for removing and inserting railroad ties comprising:

a vehicle body having first and second ends and first and second sides;

wheels attached to support said vehicle body;

a tie remover/inserter mechanism mounted to said vehicle body;

said tie remover/inserter mechanism includes a telescoping boom having a tie clamp at a distal end thereof, said telescoping boom being pivotable about a vertical pivot axis adjacent a proximal end thereof, said telescoping boom being pivotable about a horizontal pivot axis at said proximal end; and wherein said wheels include four ground engagement wheels such that the machine is operable to travel on roads and four rail engagement wheels such that the machine is operable to travel on rails and wherein said tie remover/inserter mechanism is operable to pivot said telescoping boom about said vertical axis which is widthwise offset from a central axis extending lengthwise to the machine, and wherein said horizontal pivot axis and said vertical pivot axis are each disposed on a side shift carriage which is movable in a widthwise direction relative to said vehicle body.

8. The machine of claim 7 further comprising a first boom hydraulic cylinder for pivoting said telescoping boom about said vertical pivot axis and a second boom hydraulic cylinder for pivoting said telescoping boom about said horizontal pivot axis.

9. The machine of claim 8 wherein said side shift carriage is mounted to said vehicle by way of a horizontal support on which said side shift carriage travels.

10. The machine of claim 8 further comprising:

a bucket having a front and back, and first and second sides and mounted to said first end of said body by at least one bucket support arm which is pivotable in a horizontal pivot axis at a horizontal pivot point;

a bucket hydraulic cylinder connected to said body and to said bucket support arm and operable to lift and lower said bucket by causing said at least one bucket support arm to pivot about said horizontal axis; and at least a first grader blade mounted to said first of said sides of said bucket.

11. The machine of claim 7 further comprising:

a bucket having a front and back, and first and second sides and mounted to said first end of said body by at least one bucket support arm which is pivotable in a horizontal pivot axis at a horizontal pivot point;

a bucket hydraulic cylinder connected to said body and to said bucket support arm and operable to lift and lower said bucket by causing said at least one bucket support arm to pivot about said horizontal axis; and at least a first grader blade mounted to said first of said sides of said bucket.

12. A machine for removing and inserting railroad ties comprising:

a vehicle body having first and second ends; and first and second sides;

wheels attached to support said body; a tie remover-/inserter mechanism mounted to said vehicle body;

said tie remover/inserter mechanism includes a telescoping boom having a tie clamp at a distal end thereof, said telescoping boom being pivotable about a vertical pivot axis adjacent a proximal end thereof; and a side shift carriage mounted to said vehicle body, said tie remover/inserter mechanism mounted to said vehicle body by way of said side shift carriage which is movable in a widthwise direction relative to said vehicle body.

13. The machine of claim 12 wherein said side shift carriage is mounted to said vehicle by way of a horizontal support on which said side shift carriage travels.

14. The machine of claim 13 further comprising;

a bucket having a front and back, and first and second sides and mounted to said first end of said body by at least one bucket support arm which is pivotable in a horizontal pivot axis at a horizontal pivot point;

a bucket hydraulic cylinder connected to said body and to said bucket support arm and operable to lift and lower said bucket by causing said at least one bucket support arm to pivot about said horizontal axis of said bucket support arm; at least a first grader blade mounted to said first of said sides of said bucket.

15. The machine of claim 13 wherein said tie remover/inserter mechanism includes a telescoping boom having a tie clamp at a distal end thereof, said telescoping boom being pivotable about a vertical pivot axis adjacent a proximal end thereof, said telescoping boom being pivotable about a horizontal pivot axis at said proximal end.

16. The machine of claim 15 wherein said wheels include four ground engagement wheels such that the machine is operable to travel on roads and four rail engagement wheels such that the machine is operable to travel on rails and wherein said tie remover/inserter mechanism is operable to pivot said telescoping boom about an axis which is widthwise offset from a central axis extending lengthwise to the machine.

17. The machine of claim 12 wherein said first grader blade is pivotably mounted to said first of said sides of said bucket by first front and back blade support arms and further comprising a first blade hydraulic cylinder operable to lift and lower said first grader blade.

18. The machine of claim 12 wherein said vertical pivot axis is widthwise offset from a central axis entending lengthwise to the machine when the tie remover/inserter mechanism is in a work position and said vertical pivot axis is closer to when said central axis is in a transport position.

19. A machine for removing and inserting railroad ties comprising:

an industrial tractor having a vehicle body with first and second ends and first and second sides and having wheels attached to support said vehicle body; a tie remover/inserter mechanism mounted to said vehicle body, said tie remover/inserter mechanism includes a telescoping boom having a tie clamp at a distal end thereof, said telescoping boom being pivotable relative to said vehicle body about a vertical pivot axis adjacent a proximal end thereof;

wherein said wheels include two front and two back ground engagement wheels such that the machine is operable to travel on roads and four rail engagement wheels such that the machine is operable to travel on rails, and wherein said telescoping boom has a proximal end disposed at an end of said vehicle body and outside of an interaxis zone between a front axis corresponding to said two front ground engagement wheels and a rear axis corresponding to said two back ground engagement wheels, and wherein said vertical pivot axis is widthwise offset from a central axis extending lengthwise to the machine when the tie remover/inserter mechanism is in a work position and said vertical pivot axis is closer to said central axis when said tie remover-/inserter mechanism is in a transport position.

20. The machine of claim 19 wherein said tie remover/inserter is mounted to said vehicle body by way of a support structure which is pivotably attached at a part of the frame in the interaxis zone and movably attached to a part of the frame outside the interaxis zone such that the support structure is movable up and down relative to the frame.

21. The machine of claim 19 wherein two of said four rail engagement wheels are mounted to said support structure.

22. The machine of claim 19 comprising:

a bucket having a front and back, and first and second sides and mounted to said first end of said body by at least one bucket support arm which is pivotable in a horizontal pivot axis at a horizontal pivot point; a bucket hydraulic cylinder connected to said body and to said bucket support arm and operable to lift and lower said bucket by causing said at least one bucket support arm to pivot about said horizontal axis; and at least a first grader blade mounted to said first of said sides of said bucket.

23. The machine of claim 19 wherein said industrial tractor is a backhoe-type tractor.

24. A method of making a machine for removing and inserting railroad ties, the steps, not necessarily in order, comprising:

attaching a support structure to a frame of a tractor, the tractor having a body, two front wheels for ground engagement and defining a front axis, and two rear wheels for ground engagement and defining a rear axis, there being interaxis zone between said front axis and said rear axis; and mounting a tie remover/inserter mechanism to the support structure, the tie remover/inserter mechanism having a telescoping boom with a tie clamp at a distal end thereof, said telescoping boom having a proximal end, said mounting step mounting the proximal end such that it will be disposed at an end of the tractor and outside of the interaxis zone and such that the telescoping boom can extend parallel to said rear axis for tie removal/insertion operations, and wherein the attaching step involves attaching the support structure to the frame of a standard industrial tractor commonly used for making a backhoe machine, and wherein the support structure is pivotably attachable at a part of the frame in the interaxis zone and movably attached to a part of the frame outside the interaxis zone such that the support structure is movable up and down relative to the frame.

25. The method of claim 24 further comprising the step of mounting rail engagement wheels to said support structure.

26. A method of making a machine for removing and inserting railroad ties, the steps, not necessarily in order, comprising:

attaching a support structure to a frame of a tractor, the tractor having a body, two front wheels for ground engagement and defining a front axis, and two rear wheels for ground engagement and defining a rear axis, there being interaxis zone between said front axis and said rear axis; and mounting a tie remover/inserter mechanism to the support structure, the tie remover/inserter mechanism having a telescoping boom with a tie clamp at a distal end thereof, said telescoping boom having a proximal end, said mounting step mounting the proximal end such that it will be disposed at an end of the tractor and outside of the interaxis zone and such that the telescoping boom can extend parallel to said rear axis for tie removal/insertion operations, and wherein the mounting step involves the substeps of mounting the tie remover/inserter mechanism to a side shift carriage and mounting the side shift carriage to the support structure such that the side shift is movable in a widthwise direction relative to the body.

27. A method of making a machine for removing and inserting railroad ties, the steps, not necessarily in order, comprising:

attaching a support structure to a frame of a tractor, the tractor having a body, two front wheels for ground engagement and defining a front axis, and two rear wheels for ground engagement and defining a rear axis, there being interaxis zone between said front axis and said rear axis; and mounting a tie remover/inserter mechanism to the support structure, the tie remover/inserter mechanism having a telescoping boom with a tie clamp at a distal end thereof, said telescoping boom having a proximal end, said mounting step mounting the proximal end such that it will be disposed at an end of the tractor and outside of the interaxis zone and such that the telescoping boom can extend parallel to said rear axis for tie removal/insertion operations, and wherein the tractor has a bucket having a front and back, and first and second sides and mounted to an end of the body by at least one bucket support arm which is pivotable in a horizontal pivot axis at a horizontal pivot point; and a bucket hydraulic cylinder connected to the body and to said bucket support arm and operable to lift and lower said bucket by causing said at least one bucket support arm to pivot about said horizontal axis; and further comprising the step of mounting a first grader blade to the bucket.

* * * * *